United States Patent [19]

Campbell

[11] Patent Number: 4,760,801

[45] Date of Patent: Aug. 2, 1988

[54] OUTDOOR COOKING TABLE

[76] Inventor: Ernest L. Campbell, 8129 High Oaks La., Matthews, N.C. 28105

[21] Appl. No.: 75,632

[22] Filed: Jul. 20, 1987

[51] Int. Cl.[4] ..... A47B 3/02

[52] U.S. Cl. ..... 108/119; 108/65; 108/116

[58] Field of Search ..... 108/119, 114, 59, 65, 108/69, 97, 90, 108, 114, 120, 152

[56] References Cited

U.S. PATENT DOCUMENTS

| | | | |
|---|---|---|---|
| 133,122 | 11/1872 | Schoonmaker | 108/97 |
| 313,632 | 3/1885 | Stowell | 108/116 |
| 316,363 | 4/1885 | Hough | 108/116 |
| 916,989 | 4/1909 | Braunt | 108/116 |
| 1,575,897 | 3/1926 | Cole | 108/65 X |
| 1,774,268 | 8/1930 | Harding | 108/65 X |
| 2,556,611 | 6/1951 | Borgman | 108/65 |
| 3,311,071 | 3/1967 | Cook | 108/119 |

*Primary Examiner*—Peter A. Aschenbrenner
*Attorney, Agent, or Firm*—Clifton Ted Hunt

[57] ABSTRACT

An outdoor cooking table has a top formed of spaced apart pieces to provide ventilation in the area of a cookstove supported by the table. The tabletop is adjustable to different heights, and an extension may be attached to the tabletop in cantilever fashion to extend its effective length. The tabletop is pivotally connected at one end to pivotally interconnected legs on each side of the table top and the tabletop and legs can be folded for storage and transportation without disassembly of the component parts.

4 Claims, 5 Drawing Sheets

OUTDOOR COOKING TABLE

FIELD OF THE INVENTION

This invention relates to folding tables of the type having a tabletop and a lower shelf.

BACKGROUND OF THE INVENTION

There are few facilities for campers to cook outdoors. There are portable gasoline stoves and there are portable ice chests but little choice in a support structure for such accessories. Picnic table are sometimes available for use by people cooking outdoors, but such tables are generally intended for eating instead of cooking and are too low for conveniently cooking and preparing a meal.

Other than the conventional picnic table, the adjustable nursery and camp table shown in U.S. Pat. No. 1,833,177 issued Nov. 24, 1931 to Rice is the closest known prior art to the outdoor cooking table of the present invention. Rice shows a table with pivotal end legs notched at their upper ends to releasably support a top work surface at a fixed height and a lower shelf supported on tie rods between the legs and beneath the removable top. The shelf remains with the legs when they are folded for storage, but the top is separable and must be removed from the legs before the legs can be folded. The top is stored separately.

SUMMARY OF THE INVENTION

The table of the present invention is intended for use as a portable outdoor kitchen counter to support a cook stove at one end and provide an adjoining work area for preparing meals. The top of the table is pivotally interconnected at one end between pairs of pivotal legs at the sides of the table and the top is formed from spaced apart pieces of hardwood to dissipate the heat from a cookstove intended to be supported at one end of the table.

The standard height of the table is thirty three inches, which allows three inches for the cooking surface of a stove supported by the table to be the same height as the average height of a kitchen stove. The top of the table is easily adjustable to a higher or lower height as desired. A shelf is supported between the legs and is stabilized by a support piece which is connected to the shelf and to the tabletop and extends above the tabletop to conveniently support cooking accessories such as towels, pots, and knives.

The height of the tabletop is controlled by horizontally spaced stops or retainer bars extending downwardly from the lower surface of the tabletop and engageable with a transverse support bar extending between the pairs of legs on opposite sides of the table.

A removable extension slidably overlies the end portion of the tabletop opposite the one end reserved for a cookstove. The extension is movable from a retracted position on the tabletop to an extended position beyond the tabletop, and an anchor arm and a keeper support the extension in cantilever fashion beyond the end of the table.

DETAILED DESCRIPTION OF THE INVENTION

Figure 1:
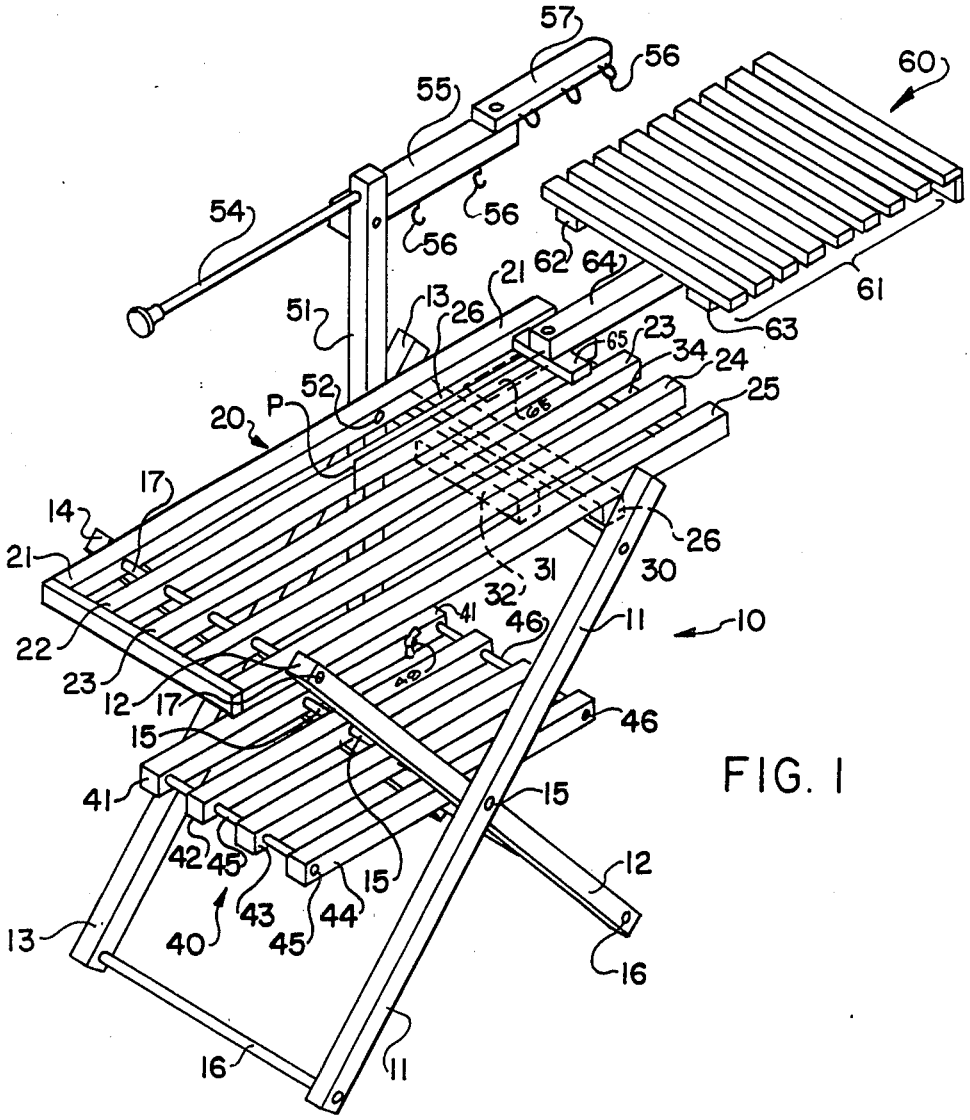
FIG. 1 an exploded perspective view of the table and the extension shown in retracted position for attachment to the tabletop and showing the tabletop at its standard height.

Referring more specifically to the drawings, the numeral 10 broadly designates a folding outdoor cooking table comprising a first pair of pivotally interconnected legs 11 and 12 on one side of the table 10 and a second pair of pivotally interconnected legs 13 and 14 on the other side of the table.

The dimensions and type of material used in describing the table are preferred because experience has shown they provide an efficient and attractive table for the intended purpose, but the dimensions and type of material are not considered essential to the satisfactory making and use of the table. In the preferred and illustrated embodiment, the legs 11–14 are formed from 2×2 inch pieces of clear fir each forty four inches long. Each leg has a ½ inch bore at its mid-point to receive a dowel 15 extending completely across the table and through the pairs of legs 11, 12 and 13, 14. Transverse dowels 16 connect the lower ends of the legs.

Each of the inside legs 12 and 14 has an opening 5/8 of an inch in diameter and spaced about one inch from the upper ends of the legs in FIG. 1 to receive a dowel 17 which is fifteen inches long and extends across one end of the table and through the upper ends of the legs 12 and 14. The dowel 17 also penetrates five pieces indicated at 21–25 and defining a table top broadly indicated at 20. The pieces 21–25 are made from 2×2 inch clear fir cut forty inches long. The dowel 17 is preferably spaced about 6 inches from the left end of the table in FIG. 1.

The dowel 17 supports the pieces of the tabletop in horizontally spaced relation to each other at one end of the table and a cross-piece 26 is fixed to the undersurface of each of the pieces 21–25 at the other end of the table. The cross-piece 26 is spaced inwardly about four and a half inches from the right end of the table in FIG. 1.

A dowel 30 extends between the outer legs 11 and 13 and is spaced about three inches from the upper ends of the legs in FIG. 1. The dowel 30 supports a 2×2 inch square support bar 31 extending between the legs 11 and 13 beneath the table top 20.

Figure 2:
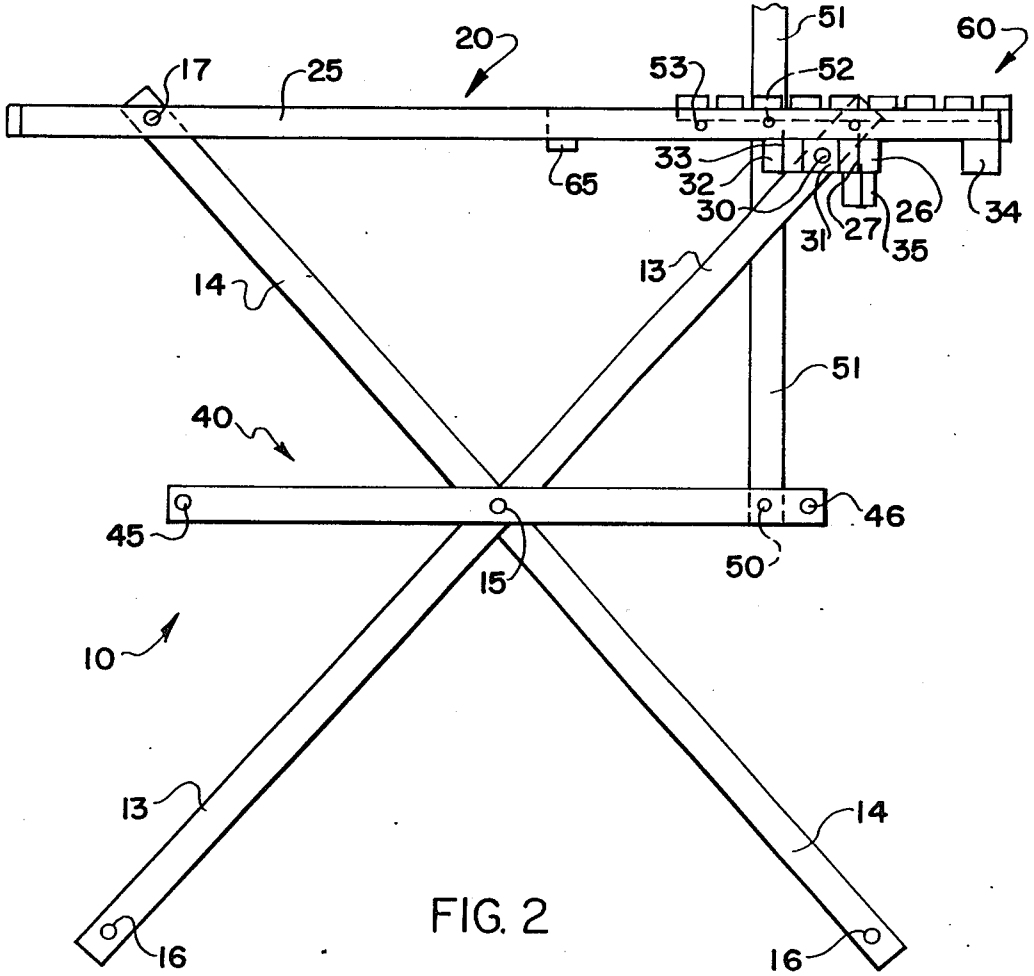
FIG. 2 a longitudinal sectional view of the table shown in FIG. 1, illustrating the structure for adjusting the height of the tabletop and showing the extension in its retracted position.

FIGS. 1 and 2 show the tabletop 20 at its standard height of thirty three inches above the supporting surface. The tabletop is retained in a horizontal position at that height by the support bar 31 engaging and bearing against the cross-piece 26 which functions as one retainer bar for holding the tabletop at the standard height of thirty three inches.

A second retainer bar 32 is fastened to the undersurface of the medial pieces 22, 23, and 24 of the tabletop 20 at a point slightly more than two inches inwardly of the cross piece 26. The tabletop 20 may be supported at an elevation higher than the standard height of FIGS. 1 and 2 by grasping the right end of the table top (in the drawings) and manually lifting it to pivot the one end of the tabletop about the dowel 17 while raising the second retainer bar 32 above the support bar 31 and moving the upper ends of the pivoted legs toward each other, thereby raising the elevation of the tabletop 20. The right end of the tabletop is then lowered into the position of FIG. 3 with the retainer bar 32 to the right and outwardly of the support bar 31 to support the tabletop at an elevated position above the standard height of the tabletop 20 in FIGS. 1 and 2.

A third retainer bar 34 extends beneath the right end of the tabletop 20 in FIG. 1 in spaced parallel relation to the cross-piece 26. The retainer bar 34 is spaced about four inches to the right of the retainer bar 26 and flush with the ends of the tabletop pieces 21–25. The retainer bar 34 functions to restrain the support bar 31 and maintain the tabletop at the lowered position of FIG. 4, below the standard countertop height of FIGS. 1 and 2. This is accomplished by raising the right end of the tabletop in FIG. 1 sufficiently for the cross-piece 26 to pass over the support bar 31 while moving the upper ends of the legs away from each other and toward the horizontal while lowering the tabletop until the support bar 31 moves into engagement with the retainer bar 34. The tabletop 20 is thus supported in the lowered position of FIG. 4.

Figure 3:
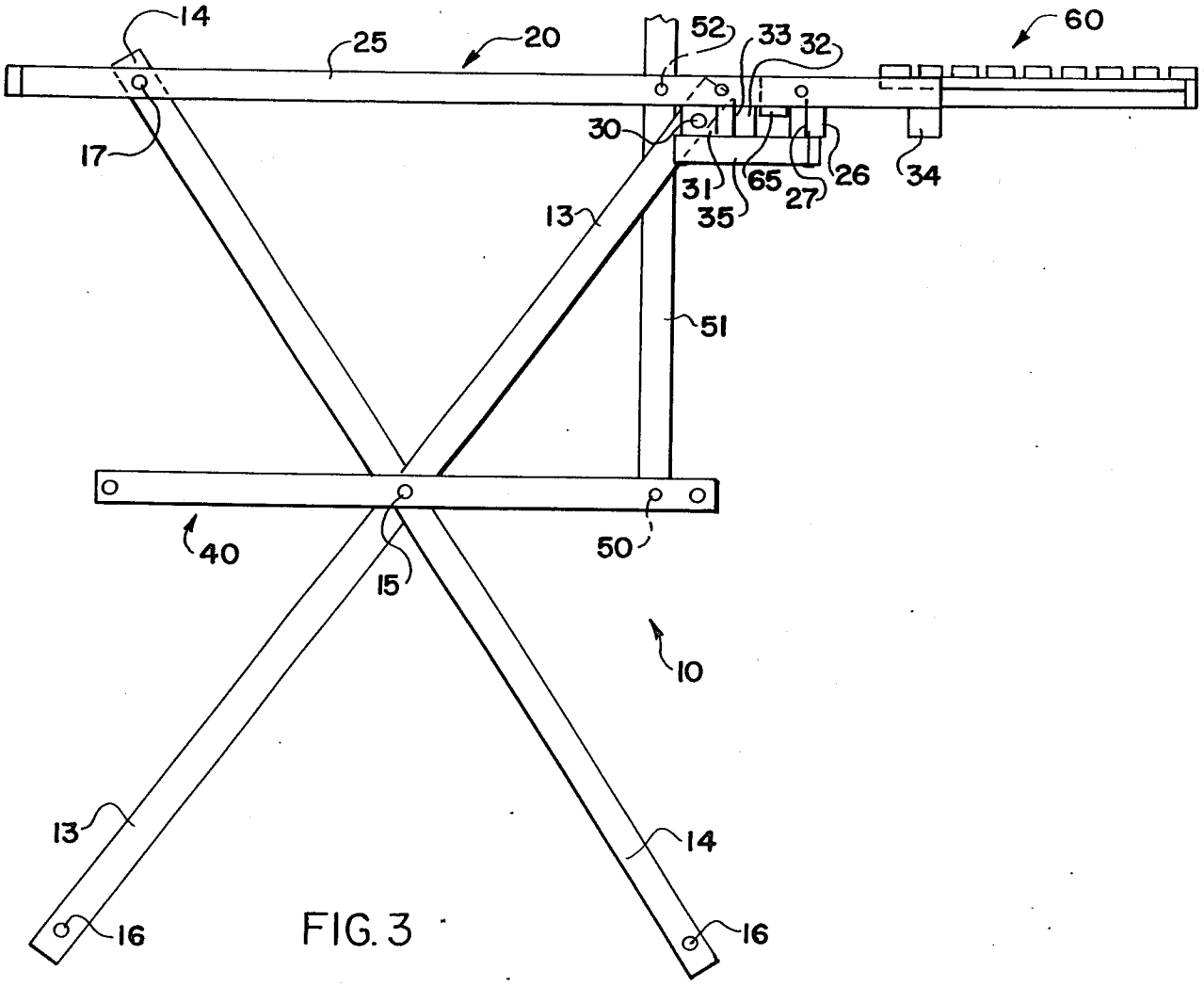
FIG. 3 view similar to FIG. 2 but illustrating the tabletop supported at its maximum height, and showing the extension in its extended position.
Figure 4:
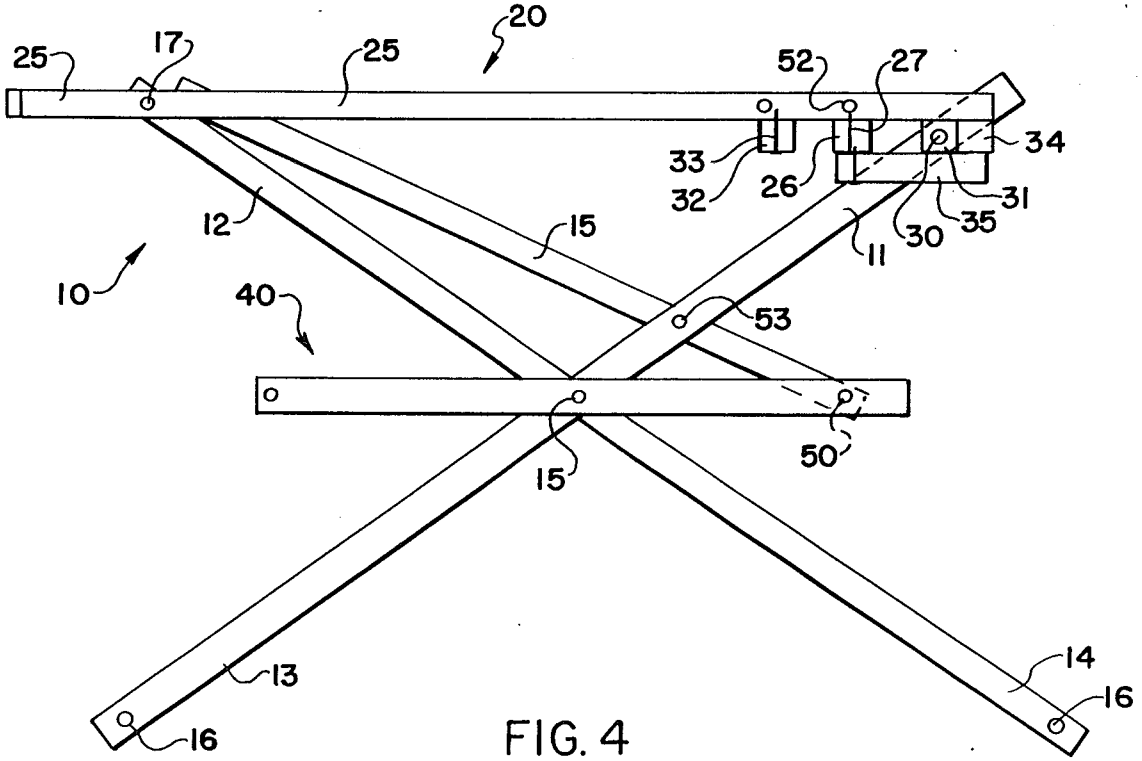
FIG. 4 a view similar to FIGS. 2 and 3 but illustrating the tabletop supported for use in its lowest position.

A locking bar 35 is pivotally connected to the lower surface of cross-bar 26 and is movable between an inactive position parallel with the longitudinal axis of cross-bar 26 (FIG. 2) and an operative position perpendicular to that axis and across the lower surface of support bar 31 to lock the tabletop to the legs at a selected height, such as the highest position of FIG. 3 or the lowest position of FIG. 4, it being understood that the locking bar 35 is rotated 180° from its FIG. 3 position to underlie the support bar 31 when the support bar is positioned to be retained by the retainer bar 34 as in FIG. 4. With the locking bar 35 in an operative position such as in FIG. 3, for example, the tabletop can be grasped to lift and move the erected table from one position to another without collapsing the legs. With the locking bar 35 in its inactive position of FIG. 2, the legs will collapse on themselves when the the tabletop is lifted high enough for the active retainer bar to clear the support bar 31.

A shelf 40 is spaced beneath the tabletop 20 and extends in parallel relation thereto. In the illustrated embodiment, the shelf 40 comprises four pieces 41, 42, 43, and 44 of 2×2 inch clear fir twenty eight inches long with bores drilled through the center to receive the dowel 15. Each of the pieces 41–44 has a one-half inch diameter hole therethrough spaced three quarters of an inch from each end to receive dowels 45 and 46 holding the pieces 41–44 in spaced relation about three inches apart between the inner legs 12 and 14.

The piece 41 of the shelf 40 has an opening therethrough between the dowels 15 and 46 to accomodate a bolt 50 with a wingnut 49 connecting the shelf 40 to a stabilizer 51 extending upwardly from the shelf 40 and connected to the piece 21 of tabletop 20 by a bolt 52 and a wingnut, not shown.

When assembled as shown in FIGS. 1, 2, and 3, the stabilizer 51 extends vertically to maintain the shelf 40 in spaced parallel relation to the tabletop 20 when the tabletop 20 is adjusted to either its highest position of FIG. 3 or its standard position of FIGS. 1 and 2. When the tabletop 20 is adjusted to its lowest position of FIG. 4, the stabilizer 51 may support the shelf in horizontal position parallel to tabletop 20 by repositioning the stabilizer from the vertical position of FIGS. 2 and 3 to the inclined position of FIG. 4, and relocating the bolt 52 from the tabletop to a hole 53 through leg 11 above the dowel 15 in FIG. 4.

When the tabletop is adjusted to the standard height of FIGS. 1 and 2 and to the higher height of FIG. 3, the stabilizer 51 extends vertically and terminates about fourteen inches above the tabletop. The upper end of the stabilizer may be equipped with a horizontally extending dowel 54 defining a convenient towel rack. A horizontally extending arm 55 may be equipped with hooks 56 to support utensils, knives, and other cooking accessories. A pivotal arm 57 may be connected to the arm 55 for movement away from the table for supporting long handled forks and the like which would otherwise inconveniently rest against the surface of the table.

An extension of the tabletop is broadly indicated at 60 and comprises a plurality of relatively closely spaced pieces, collectively indicated at 61, extending transversely of the tabletop 20 and perpendicularly to the pieces 21–25 of the tabletop 20. The pieces 61 are united by longitudinal frame members 62 and 63 which seat in the space between pieces 22, 23 and 24, 25 and rest on the retainers 26 and 34 when the extension 60 is assembled to the tabletop 20.

The extension 60 is releasably held on the tabletop 20 by an anchor arm 64 extending in spaced parallel relation between the frame members 62 and 63. The anchor arm 64 is fastened to the under surface of the pieces 61 and extends between the pieces 23 and 24 of tabletop 20 toward the middle of the table in FIG. 1. A locking lug 65 is pivotally connected to and depends from the anchor arm 64. Extending transversely of the table, as shown in solid lines in FIG. 1, the lug 65 is in in its transverse locking position, extending across the pieces 23 and 24 of the tabletop for engagement with their undersurfaces to support the extension in cantilever fashion while the frames 62 and 63 rest on the retaining bar 34 (FIG. 3). The locking lug 65 may be rotated 90° to the dotted line position of FIG. 1, which is parallel with the anchor arm 64, when it is desired to remove the extension 60 from the tabletop 20. The extension 60 is then removed by simply lifting it from the tabletop.

The projection line P in FIG. 1 illustrates that the locking lug 65 is located at about the mid-point of the tabletop 20 and to the left of the retainer 32 when the extension is seated in its retracted position on the tabletop 20, as shown in FIG. 2. The extension may be moved to the right while remaining connected to the tabletop when it is desired to extend the effective length of the table. Maximum extension is obtained when the locking lug 65 engages the retainer 32 beneath the tabletop pieces 23 and 24.

OPERATION

The hinged connection of one end of the tabletop to the legs, afforded by the dowel 17, and the releasable connection of the other end of the tabletop to the legs, afforded by the support bar 31 and a selected retaining bar 26, 32 or 34, enables the table to remain assembled when folded for storage. It can be quickly erected from the folded position of FIG. 5 to a selected height by simply lifting the table top to extend the legs and positioning the support bar 31 against a selected retainer bar. Alternatively, the folded table may be rested on the end nearest the dowel 17 connecting the legs to the tabletop while the legs are extended to position the support bar 31 against a selected retainer bar and the locking lug 35 is moved into locking position to hold the legs and tabletop together. The table is then easily manipulated to be supported on its legs.

Figure 5:
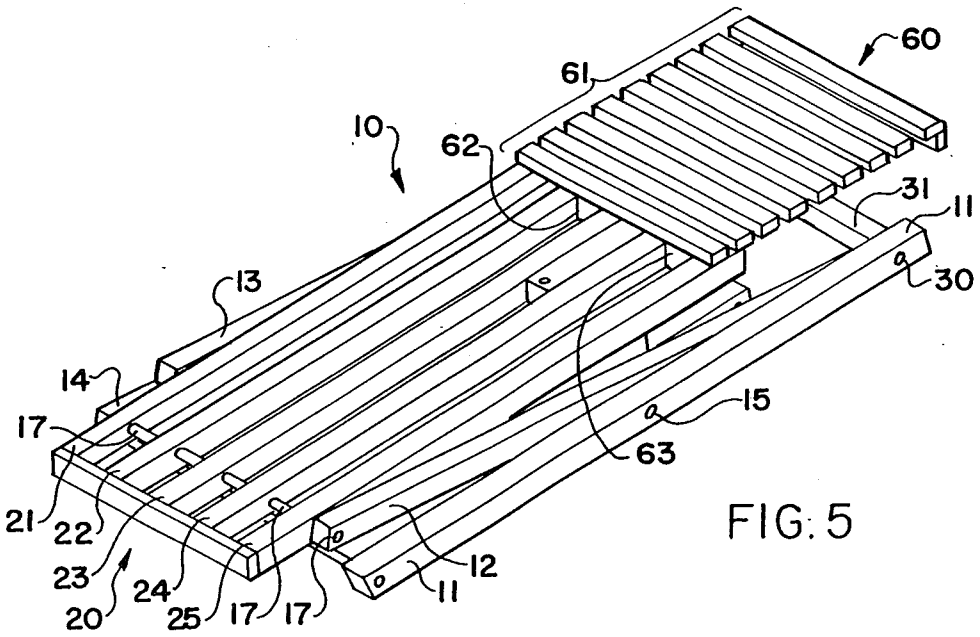
FIG. 5 a perspective view of the table folded for storage and transportation.

The table 10 may be folded into the compact storage position of FIG. 5 by first moving the locking lug 35 to the inactive position illustrated in FIG. 2 and then lifting the end of the table opposite the dowel 17 just enough to lift the active retainer bar above the support bar 31 and then collapsing the legs into the position of FIG. 5.

There is thus provided an effective outdoor cooking table which may be adjusted to a desired height, which may be extended to a desired length in use, and which may be quickly erected without the assembly of any parts and quickly folded into a compact unitary structure for storage. The table has been described as an outdoor cooking table but it is apparent that the table can serve any desired purpose, such as an indoor or outdoor plant stand, or portable work bench.

Although specific terms have been employed in describing the invention, they have been used in a descriptive sense only and not for purposes of limitation.

I claim:

1. A table comprising two pairs of pivotally interconnected legs, a tabletop between the two pairs of legs, mean pivotally connecting one end of the tabletop to the legs, a support bar extending between the upper ends of opposing legs and at least one retainer bar extending transversely beneath the tabletop and engageable with the support bar, said tabletop being formed from a first group of pieces extending parallel with the longitudinal axis of the table, said first group of pieces being elongated and corresponding in length with the normal length of the table, means supporting the first group of pieces in horizontally spaced relation to each other, a removable extension of the tabletop normally supported on top of the first group of pieces at one end of the table, said extension comprising a second group of relatively closely spaced pieces extending perpendicularly to the said first group of pieces and frame members uniting the second group of pieces and extending perpendicularly to the said second group of pieces and positioned between adjacent pieces in said first group of pieces in the tabletop, said frame members resting on said transversely extending retainer bar, an anchor arm fastened to the under surface of the second group of pieces in spaced parallel relation between said frame members and extending between adjacent pieces in said first group of pieces in the tabletop, and a locking lug pivotally connected to and depending from the anchor arm for movement between an inactive position parallel with the anchor arm when the extension is supported on one end of the table and a locking position transverse to the anchor arm for engagement with the under surfaces of pieces in said first group of pieces to anchor the extension in cantilever fashion beyond said one end of the table.

2. A table comprising two pairs of legs, a transversely extending dowel pivotally interconnecting the legs at their mid-points, a tabletop between the two pairs of legs, means pivotally connecting one end of the tabletop to the legs, means releasably connecting the other end of the table to the legs for selectively supporting the tabletop at one of a plurality of predetermined heights, a shelf extending in spaced parallel relation beneath the tabletop and supported at its mid-point by said transversely extending dowel, and means for maintaining the shelf in spaced parallel relation beneath the tabletop, whereby the tabletop may be adjusted to a selected predetermined height and the shelf remain in spaced parallel relation to the tabletop.

3. A table according to claim 2 wherein said means for maintaining the shelf in spaced parallel relation beneath the table top comprises a vertically extending stabilizing rod.

4. A table according to claim 2 wherein the shelf comprises a plurality of horizontally spaced pieces.

* * * * *